US012326266B2

(12) United States Patent
Boyd et al.

(10) Patent No.: US 12,326,266 B2
(45) Date of Patent: Jun. 10, 2025

(54) ENERGY EFFICIENT HVAC SYSTEM WITH VARIABLE CAPACITY START UP CONTROL

(71) Applicant: Johnson Controls Tyco IP Holdings LLP, Milwaukee, WI (US)

(72) Inventors: Andrew Michael Boyd, Wichita, KS (US); Theresa Thy N. Gillette, Wichita, KS (US); Cameron S. Noggle, Wichita, KS (US); Jeremy Ryan Smith, Park City, KS (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 0 days.

(21) Appl. No.: 18/539,766

(22) Filed: Dec. 14, 2023

(65) Prior Publication Data

US 2024/0200815 A1 Jun. 20, 2024

Related U.S. Application Data

(60) Provisional application No. 63/432,653, filed on Dec. 14, 2022.

(51) Int. Cl.
*F24F 11/46* (2018.01)
*F24F 11/86* (2018.01)
*F24F 110/10* (2018.01)

(52) U.S. Cl.
CPC ..... *F24F 11/46* (2018.01); *F24F 11/86* (2018.01); *F24F 2110/10* (2018.01)

(58) Field of Classification Search
None
See application file for complete search history.

(56) References Cited

U.S. PATENT DOCUMENTS

| | | | | |
|---|---|---|---|---|
| 8,797,199 | B1 * | 8/2014 | Goodnow | G05B 19/042 341/142 |
| 10,222,109 | B2 * | 3/2019 | Tran | F24F 11/86 |
| 10,788,247 | B2 | 9/2020 | Popli | |
| 11,486,599 | B2 | 11/2022 | Goel et al. | |
| 11,754,304 | B2 * | 9/2023 | Seiler | F24F 11/64 700/276 |

(Continued)

FOREIGN PATENT DOCUMENTS

| | | | | |
|---|---|---|---|---|
| CN | 105402848 B | * 12/2018 | | F24F 11/30 |
| CN | 114963478 A | 8/2022 | | |

*Primary Examiner* — Thomas C Lee
*Assistant Examiner* — Anzuman Sharmin
(74) *Attorney, Agent, or Firm* — Fletcher Yoder, PC

(57) ABSTRACT

An energy efficient heating, ventilation, and air conditioning (HVAC) system includes a variable capacity compressor configured to operate at a plurality to operating capacities and a control system communicatively coupled to the variable capacity compressor. The control system is configured to receive data indicative of a temperature within a conditioned space, receive data indicative of a set point temperature of the conditioned space, initialize operation of the variable capacity compressor, and ramp up operation of the variable capacity compressor to an intermediate operating capacity of the plurality of operating capacities during initial operation of the variable capacity compressor, where the intermediate operating capacity is less than a full operating capacity of the plurality of operating capacities.

17 Claims, 8 Drawing Sheets

(56) References Cited

U.S. PATENT DOCUMENTS

| | | | | |
|---|---|---|---|---|
| 2015/0337831 | A1* | 11/2015 | Zhou | F24F 11/62 700/282 |
| 2017/0268812 | A1* | 9/2017 | Trudeau | F25B 49/022 |
| 2017/0356668 | A1* | 12/2017 | Goel | F24F 11/30 |
| 2018/0372385 | A1* | 12/2018 | Cline | F25B 25/005 |
| 2019/0128554 | A1* | 5/2019 | Popli | F24F 11/42 |
| 2019/0170417 | A1* | 6/2019 | Popli | F24F 11/30 |
| 2023/0152018 | A1* | 5/2023 | Cluff | F25B 49/022 62/56 |
| 2023/0408186 | A1* | 12/2023 | Cha | F25D 29/00 |

* cited by examiner

ENERGY EFFICIENT HVAC SYSTEM WITH VARIABLE CAPACITY START UP CONTROL

CROSS-REFERENCE TO RELATED APPLICATIONS

This application claims priority from and the benefit of U.S. Provisional Patent Application No. 63/432,653, entitled "CONTROL SYSTEMS AND METHODS FOR HVAC SYSTEM AT START UP," filed Dec. 14, 2022, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Embodiments of the present disclosure are directed to heating, ventilation, and/or air conditioning (HVAC) systems configured to operate with reduced energy consumption and reduced greenhouse gas emissions. More particularly, embodiments of the present disclosure are directed to energy efficient HVAC systems configured to operate at variable capacities with improved efficiency and reduced energy consumption at start up of the HVAC system, which reduces corresponding generation of greenhouse gas emissions A heating, ventilation, and/or air conditioning (HVAC) system may be used to thermally regulate an environment, such as a space within a building, home, or other structure. The HVAC system generally includes a vapor compression system having heat exchangers, such as a condenser and an evaporator, which transfer thermal energy between the HVAC system and the environment. Typically, a compressor is fluidly coupled to a refrigerant circuit of the vapor compression system and is configured to circulate a working fluid (e.g., refrigerant) between the condenser and the evaporator. In this way, the compressor facilitates heat exchange between the refrigerant, the condenser, and the evaporator. In some cases, the HVAC system may be a heat pump configured to enable reversal of refrigerant flow through the refrigerant circuit. As such, the heat pump enables the condenser to operate as an evaporator (e.g., a heat absorber) and the evaporator to operate as a condenser (e.g., a heat rejector). Accordingly, the HVAC system may operate in multiple operating modes (e.g., a cooling mode, a heating mode) to provide both heating and cooling to the building with one refrigerant circuit. In other embodiments, the HVAC system may include a furnace, and the HVAC system may operate the refrigerant circuit in a cooling mode and may operate the furnace in a heating mode. Unfortunately, traditional HVAC systems may operate inefficiently during start up in certain operating conditions. It is now recognized that such inefficiencies can result in unnecessary energy consumption and associated emissions.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment of the present disclosure an energy efficient heating, ventilation, and air conditioning (HVAC) system includes a variable capacity compressor configured to operate at a plurality to operating capacities and a control system communicatively coupled to the variable capacity compressor. The control system is configured to receive data indicative of a temperature within a conditioned space, receive data indicative of a set point temperature of the conditioned space, initialize operation of the variable capacity compressor, and ramp up operation of the variable capacity compressor to an intermediate operating capacity of the plurality of operating capacities during initial operation of the variable capacity compressor, where the intermediate operating capacity is less than a full operating capacity of the plurality of operating capacities.

In another embodiment, a control system for an energy efficient heating, ventilation, and air conditioning (HVAC) system, includes processing circuitry and non-transitory, machine-readable-media comprising instructions stored thereon. The instructions, when executed by the processing circuitry, cause the processing circuitry to receive data indicative of a temperature within a conditioned space, receive data indicative of a set point temperature of the conditioned space, determine a deviation between the temperature and the set point temperature, initialize operation of a compressor of the energy efficient HVAC system at an intermediate capacity of a plurality of operating capacities of the compressor, and maintain operation of the compressor at the intermediate operating capacity in response to a determination that the deviation is equal to or less than a threshold difference value.

In yet another embodiment, an energy efficient heating, ventilation, and air conditioning (HVAC) system includes a controller. The controller is configured to receive a call for conditioning, initialize operation of the energy efficient HVAC system at an intermediate operating capacity of a plurality of intermediate operating capacities in response to receipt of the call for conditioning, receive data indicative of a set point temperature of a conditioned space from a thermostat of the energy efficient HVAC system, receive data indicative of a temperature within the conditioned space from a sensor of the energy efficient HVAC system, determine a deviation between the temperature and the set point temperature; compare the deviation to a threshold difference value, and maintain operation of the energy efficient HVAC system at the intermediate operating capacity for a predetermined period of time in response to a determination that the deviation is equal to or less than the threshold difference value.

BRIEF DESCRIPTION OF THE DRAWINGS

Various aspects of this disclosure may be better understood upon reading the following detailed description and upon reference to the drawings in which.

DETAILED DESCRIPTION

Figure 1:
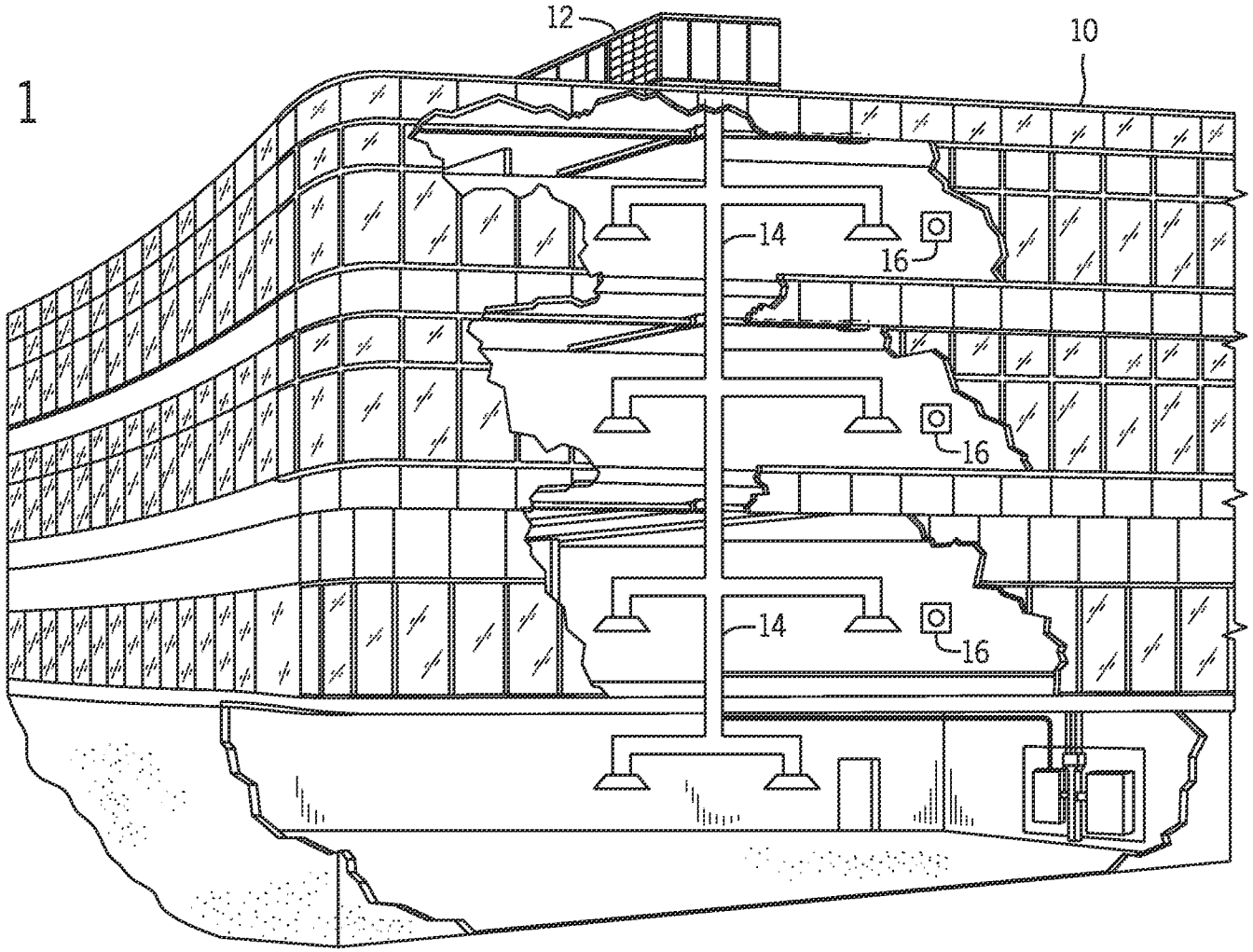
FIG. 1 is a perspective view of an embodiment of a building incorporating a heating, ventilation, and/or air conditioning (HVAC) system in a commercial setting, in accordance with an aspect of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

As briefly discussed above, a heating, ventilation, and/or air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes heat exchangers, such as a condenser and an evaporator, which are fluidly coupled to one another via one or more conduits of a working fluid loop or circuit. A compressor (e.g., a variable speed compressor) may be used to circulate the working fluid through the conduits and other components of the working fluid circuit (e.g., an expansion device) and, thus, enable the transfer of thermal energy between components of the working fluid circuit (e.g., between the condenser and the evaporator) and one or more thermal loads (e.g., an environmental air flow, a supply air flow). Additionally or alternatively, the HVAC system may include a heat pump (e.g., a heat pump system) having a first heat exchanger (e.g., a heating and/or cooling coil, an indoor coil, the evaporator) positioned within the space to be conditioned, a second heat exchanger (e.g., a heating and/or cooling coil, an outdoor coil, the condenser) positioned in or otherwise fluidly coupled to an ambient environment (e.g., the atmosphere), and a pump (e.g., the compressor) configured to circulate the working fluid (e.g., refrigerant) between the first and second heat exchangers to enable heat transfer between the thermal load and the ambient environment, for example.

The heat pump system is operable to provide both cooling and heating to the space to be conditioned (e.g., a room, zone, or other region within a building) by adjusting a flow of the working fluid through the working fluid circuit. For example, during operation of the heat pump system in a cooling mode, the compressor may direct working fluid through the working fluid circuit and the first and second heat exchangers in a first flow direction. While receiving working fluid in the first flow direction, the first heat exchanger (which may be positioned within the space to be conditioned) may operate as an evaporator and, thus, enable working fluid flowing through the first heat exchanger to absorb thermal energy from an air flow directed to the space. Further, the second heat exchanger (which may be positioned in the ambient environment surrounding the heat pump system), may operate as a condenser to reject the heat absorbed by the working fluid flowing from the first heat exchanger (e.g., to an ambient air flow directed across the second heat exchanger). In this way, the heat pump system may facilitate cooling of the space or other thermal load serviced by (e.g., in thermal communication with) the first heat exchanger.

Conversely, during operation in a heating mode, a reversing valve (e.g., a switch-over valve) enables the compressor to direct working fluid through the working fluid circuit and the first and second heat exchangers in a second flow direction, opposite the first flow direction. While receiving working fluid in the second flow direction, the first heat exchanger may operate as a condenser instead of an evaporator, and the second heat exchanger may operate as an evaporator instead of a condenser. As such, the first heat exchanger may receive (e.g., from the second heat exchanger) a flow of heated working fluid to reject heat to thermal load serviced by the first heat exchanger (e.g., an air flow directed to the space) and, thus, facilitate heating of the thermal load. In this way, the heat pump system may facilitate either heating or cooling of the thermal load based on the current operational mode of the heat pump system (e.g., based on a flow direction of working fluid along the working fluid circuit).

In additional or alternative embodiments, the HVAC system may include a furnace in addition to the vapor compression system. In such embodiments, the HVAC system may operate the furnace to provide heating to a thermal load in a heating mode of the HVAC system, and the HVAC system may operate the vapor compression circuit to facilitate cooling of the thermal load in a cooling mode of the HVAC system.

Unfortunately, existing HVAC systems may be susceptible to operational efficiencies in certain conditions or circumstances. For example, at start up (e.g., initialization of operation) of the HVAC system, existing HVAC systems may operate the compressor by ramping a speed of the compressor up to an upper limit (e.g., a maximum speed, upper threshold, maximum operating capacity). In certain circumstances, such as instances in which a temperature of a conditioned space is within a threshold amount (e.g., deadband) of a target temperature (e.g., set point temperature), initializing operation of the HVAC system and ramping the compressor speed up to an upper limit or operating capacity may cause the HVAC system to operate inefficiently. For example, the HVAC system may operate to over-condition the conditioned space, thereby resulting in increased energy consumption and corresponding production of greenhouse gas emissions.

Accordingly, embodiments of the present disclosure relate to an HVAC system configured to enable more efficient operation during initial operation of the HVAC system, which reduces energy consumption of the HVAC system and thereby reduces corresponding greenhouse gas emissions. In particular, upon start up (e.g., in response to a call for conditioning, such as heating or cooling) the HVAC system may initially operate at an intermediate (e.g., reduced) operating capacity. For example, a compressor of the HVAC system or a furnace of the HVAC system may operate at an intermediate capacity that is less than a full (e.g., maximum, upper limit) capacity at initial start up of the HVAC system. As will be appreciated, the HVAC system may operate at the intermediate operating capacity with reduced energy consumption (e.g., compared to operation at full capacity). In response to a determination that a difference between a temperature of a conditioned space and a set point or target temperature of the conditioned space is within a threshold difference value (e.g., deadband region), the HVAC system may operate at the intermediate capacity for a predetermined period of time. Upon lapse of the predetermined period of time, and in response to a subsequent determination that the difference between the temperature of the conditioned space and the set point of the conditioned space remains within or below the threshold difference value, the HVAC system may ramp down to operate at a further reduced operating capacity (e.g., minimum allowable capacity). In this way, the HVAC system may operate with further reduced energy consumption. The HVAC system may operate at the further reduced operating capacity until the difference between the temperature of the conditioned space and the set point of the conditioned space exceeds the threshold difference value or until a demand for conditioning by the HVAC system is satisfied. In this way, the HVAC system may operate more efficiently. For example, the HVAC system may not initialize operation and over-condition the conditioned space, thereby reducing energy consumption by the HVAC system and reducing corresponding greenhouse gas emissions, as well as providing more stable, desirable conditioning of the conditioned space.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12 with a reheat system in accordance with present embodiments. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
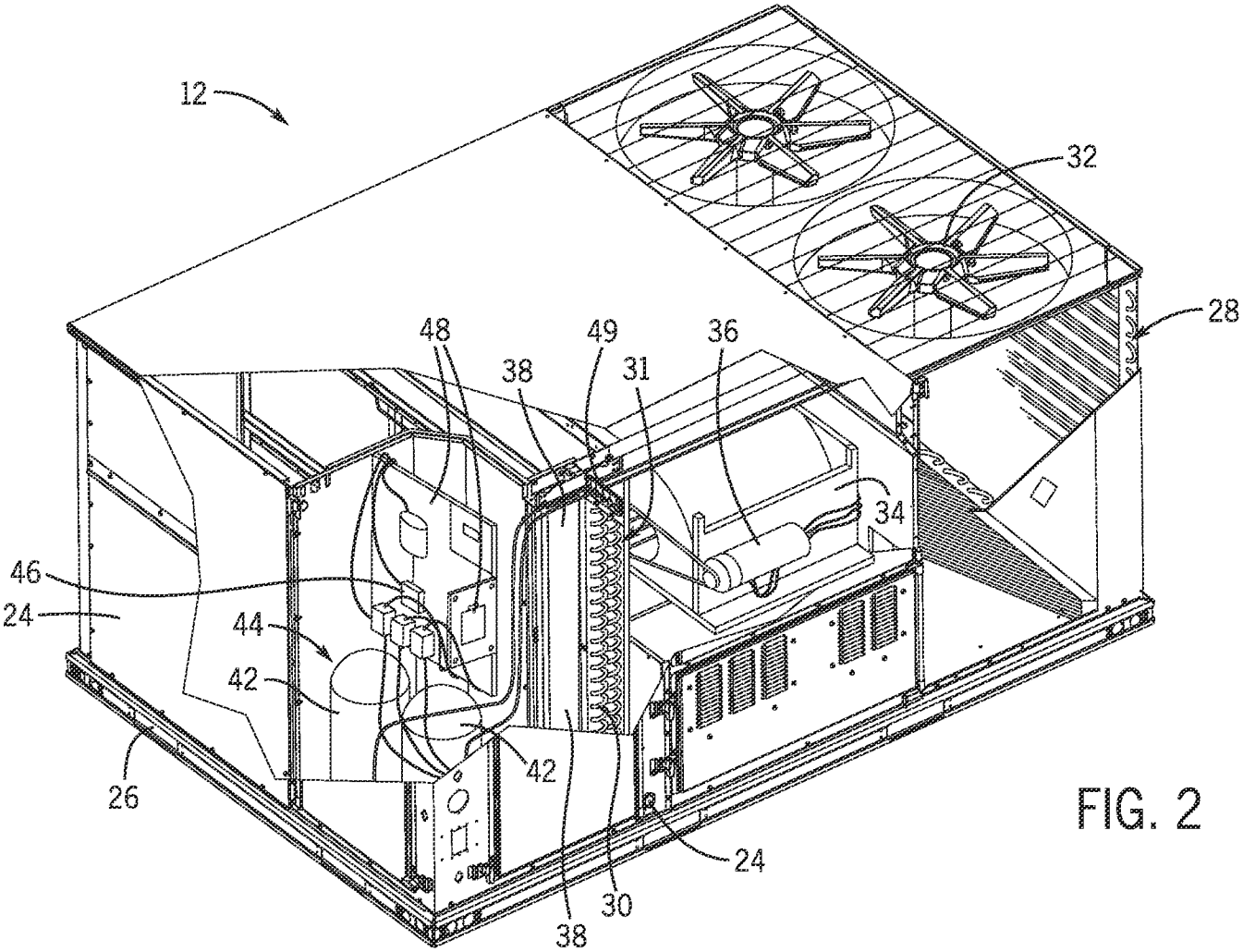
FIG. 2 is a perspective view of an embodiment of a packaged HVAC unit, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more working fluid circuits. Tubes within the heat exchangers 28 and 30 may circulate a working fluid, such as a refrigerant, through the heat exchangers 28 and 30. The tubes may be of various types, such as multichannel tubes, conventional copper or aluminum tubing, and so forth. Together, the heat exchangers 28 and 30 may implement a thermal cycle in which the working fluid undergoes phase changes and/or temperature changes as it flows through the heat exchangers 28 and 30 to produce heated and/or cooled air. For example, the heat exchanger 28 may function as a condenser where heat is released from the working fluid to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the working fluid before the working fluid enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
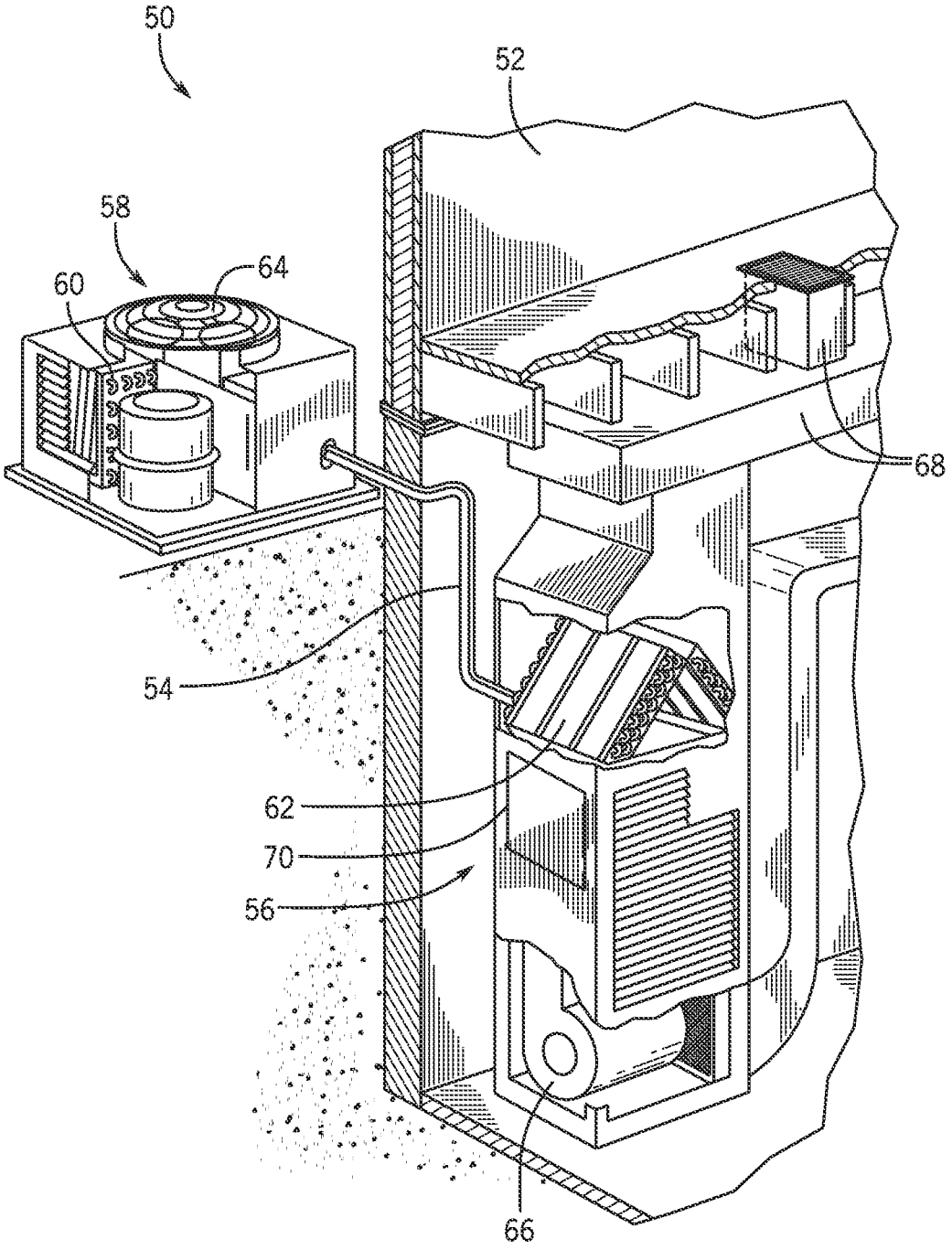
FIG. 3 is a perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The working fluid conduits 54 transfer working fluid between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily. The outdoor unit 58 includes a reheat system in accordance with present embodiments.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over the outdoor heat exchanger 60. The indoor heat exchanger 62 will receive a stream of air blown over it and will heat the air by condensing the working fluid.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
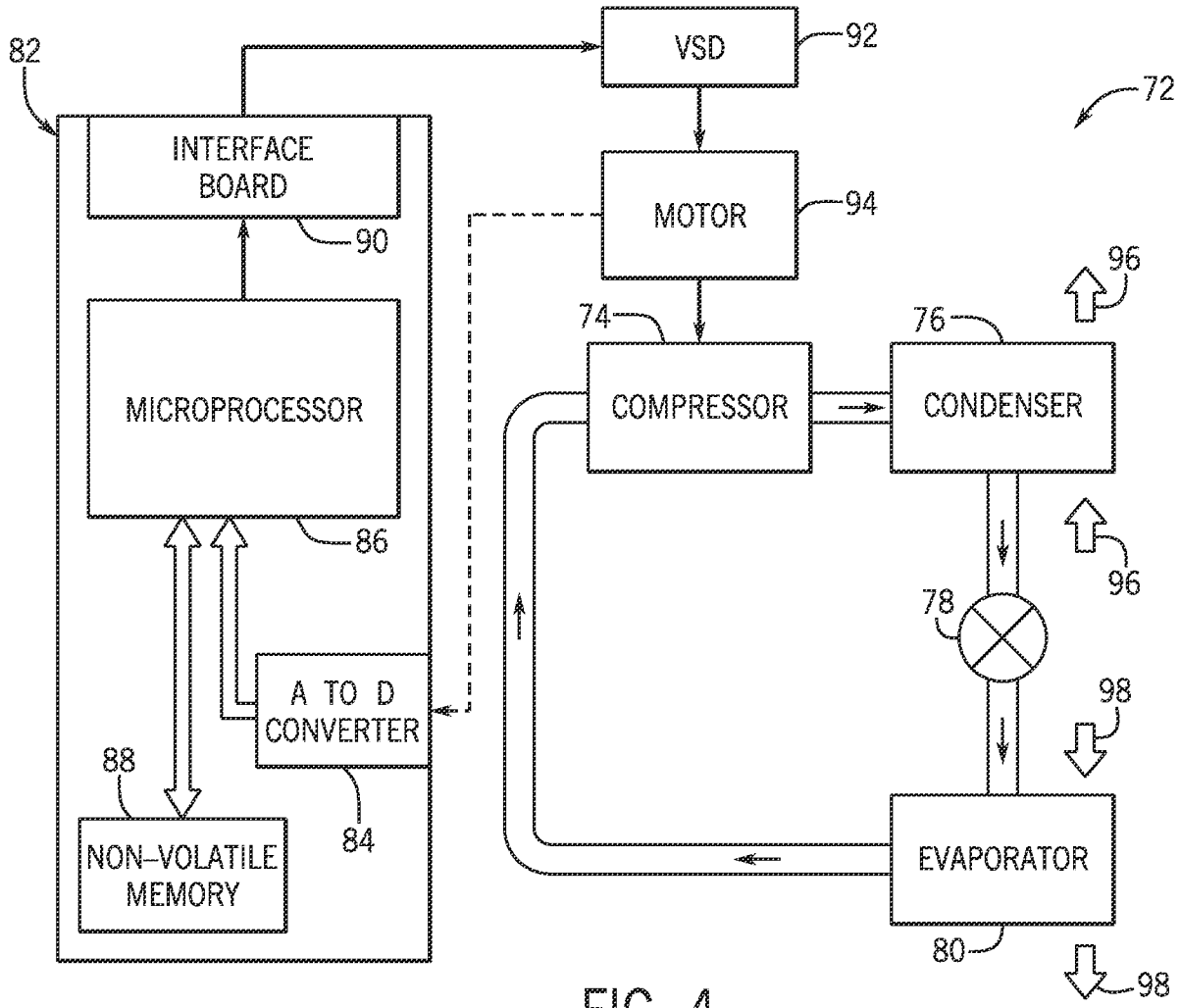
FIG. 4 is a schematic diagram of an embodiment of a vapor compression system used in an HVAC system, in accordance with an aspect of the present disclosure.

FIG. 4 is an embodiment of a vapor compression system 72 that can be used in any of the systems described above. The vapor compression system 72 may circulate a working fluid through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a working fluid vapor and delivers the vapor to the condenser 76 through a discharge passage. In some embodiments, the compressor 74 may be a centrifugal compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96. The liquid working fluid from the condenser 76 may flow through the expansion device 78 to the evaporator 80.

The liquid working fluid delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid working fluid in the evaporator 80 may undergo a phase change from the liquid working fluid to a working fluid vapor. In this manner, the evaporator 80 may reduce the temperature of the supply air stream 98 via thermal heat transfer with the working fluid. Thereafter, the vapor working fluid exits the evaporator 80 and returns to the compressor 74 by a suction line to complete the cycle.

In some embodiments, the vapor compression system 72 may further include a reheat coil. In the illustrated embodiment, the reheat coil is represented as part of the evaporator 80. The reheat coil is positioned downstream of the evaporator heat exchanger relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
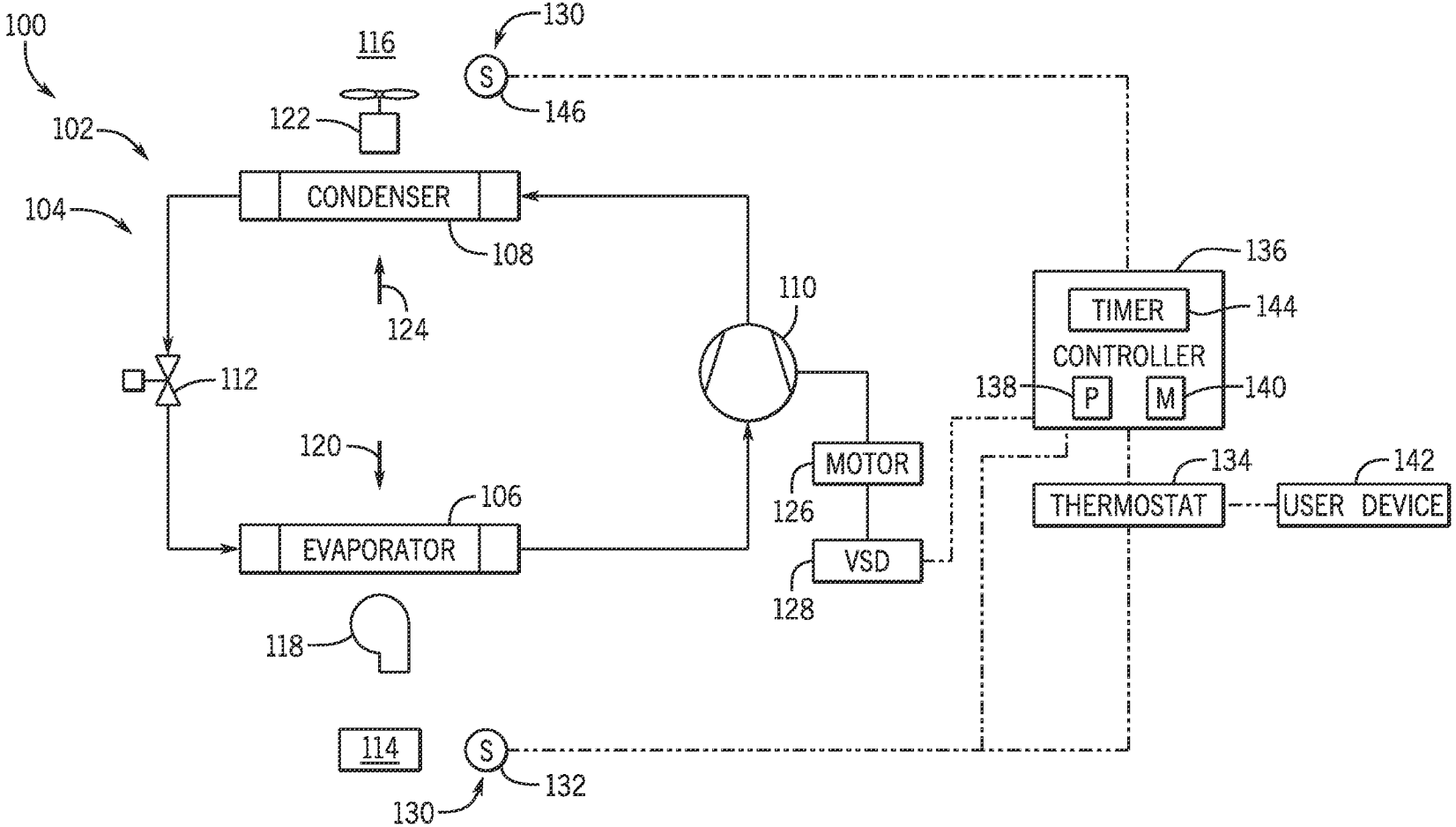
FIG. 5 is a schematic diagram of an embodiment of an HVAC system including a vapor compression system and a controller configured to enable improved operation of the HVAC system at start up, in accordance with an aspect of the present disclosure.

As briefly discussed above, embodiments of the present disclosure are directed to an HVAC system configured to enable more efficient operation and with reduced energy consumption upon initial start up of the HVAC system, such as operation of the HVAC system that is initiated in response to a call for conditioning (e.g., heating, cooling) received by the HVAC system. To provide context for the following discussion, FIG. 5 is a schematic of an embodiment of an HVAC system 100 (e.g., energy efficient HVAC system, variable capacity HVAC system) that includes a vapor compression circuit 102. It should be appreciated that the HVAC system 100 may include embodiments or components of the HVAC unit 12 shown in FIGS. 1 and 2, embodiments or components of the split residential heating and cooling system 50 shown in FIG. 3, embodiments or components of the vapor compression 72 shown in FIG. 4, a rooftop unit (RTU), or any other suitable air handling unit or HVAC system.

As shown, the vapor compression system 102 includes a working fluid circuit 104 (e.g., refrigerant circuit) having an evaporator 106 (e.g., indoor heat exchanger, first heat exchanger), a condenser 108 (e.g., outdoor heat exchanger, second heat exchanger), a compressor 110, and an expansion valve 112 (e.g., an electronic expansion valve, expansion device). The evaporator 106 may be in thermal communication with (e.g., fluidly coupled to) a thermal load 114 (e.g., a room, space, and/or device) serviced by the HVAC system 100, and the condenser 108 may be in thermal communication with an ambient environment 116 (e.g., the atmosphere) surrounding the HVAC system 100. The HVAC system 100 also includes a first fan 118 (e.g., blower, indoor fan, supply air fan) configured to direct a first air flow 120 across the evaporator 106 to facilitate heat exchange between working fluid within the evaporator 106 and the first air flow 120 directed to the thermal load 114 (e.g., a conditioned space). A second fan 122 (e.g., outdoor fan, condenser fan) may direct a second air flow 124 across the condenser 108 to facilitate heat exchange between working fluid within the condenser 108 and the second air flow 124 of the ambient environment 116. The expansion valve 112 is disposed along the working fluid circuit 104 between the evaporator 106 and the condenser 108 and may be configured to regulate (e.g., throttle) a working fluid flow and/or a working fluid pressure differential between the evaporator 106 and the condenser 108.

In the illustrated embodiment, the HVAC system 100 is configured to operate as an air conditioner. That is, the HVAC system 100 is configured to operate in a cooling mode to provide cooling to the thermal load 114. To this end, the compressor 110 is configured to direct a flow of heated working fluid along the working fluid circuit 104 to the condenser 108. The condenser 108 is configured to transfer thermal energy (e.g., heat) from the working fluid to the second air flow 124, thereby cooling and condensing the working fluid. The working fluid may then flow from the condenser 108, along the working fluid circuit 104, and through the expansion valve 112, which may reduce a pressure of the working fluid and further cool the working fluid. The cooled working fluid is then directed to the evaporator 106, which is configured to enable transfer of thermal energy from the first air flow 120 to the working fluid. In this way, the first air flow 120 may be cooled, and the first air flow 120 may be directed (e.g., via the first fan 118) to a conditioned space to provide cooling for the conditioned space. The working fluid may then be directed from the evaporator 106 back to the compressor 110, as similarly discussed above. In some embodiments, the HVAC system 100 may also include a furnace configured to operate to heat an air flow (e.g., the first air flow 120) in a heating mode of the HVAC system 100. It should be appreciated that the techniques described herein may be incorporated in HVAC systems having other configurations, components, operating modes, and so forth. For example, as described further below with reference to FIGS. 6 and 7, the present techniques may be incorporated with embodiments of the HVAC system 100 configured as a heat pump and/or embodiments of the HVAC system 100 having a furnace system.

The HVAC system 100 may also be a variable capacity system. More specifically, the HVAC system 100 may include one or more components configured to enable operation of the HVAC system 100 at variable operating capacities to condition the first air flow 120 provided to the thermal load 114 (e.g., a conditioned space). To this end, the compressor 110 may be a variable capacity compressor, and the compressor 110 may be driven by a motor 126 (e.g., motor 94) configured to operate the compressor 110 at variable speeds. The motor 126 may be powered by a variable speed drive (VSD) 128 to enable operation of the compressor 110 at variable speeds and thereby enable operation of the HVAC system 100 at different operating capacities. In other embodiments, the motor 126 may be configured to operate at variable speeds without the VSD 128.

In general, the HVAC system 100 may initialize operation upon supply of power to the HVAC system 100. That is, the HVAC system 100 may transition from an idle or non-operating state to an operating state upon supply of power to the HVAC system 100. For example, the HVAC system 100 my initialize operation upon receipt of a call for conditioning (e.g., call for cooling, call for heating) received by the HVAC system 100. To this end, the HVAC system 100 may include one or more sensors 130, which may include a first sensor 132 (e.g., one or more first sensors) configured to detect an operating parameter indicative of a temperature of the thermal load 114 (e.g., within a space conditioned by the HVAC system 100). For example, the first sensor 132 may be a temperature sensor disposed within the thermal load 114 (e.g., within the conditioned space) and configured to detect a temperature within the thermal load 114. Additionally or alternatively, the first sensor 132 may be a return air temperature sensor configured to detect a temperature of a return air flow received by the HVAC system 100 from the thermal load 114 (e.g., conditioned space).

The HVAC system 100 may also include a thermostat 134 (e.g., control device 16, mobile device, etc.) configured to receive a user input indicative of a set point temperature or target temperature of the thermal load 114 (e.g., conditioned space). In some embodiments, the thermostat 134 may be configured to receive the operating parameter indicative of the temperature within the space from the first sensor 132. Based on a determined difference (e.g., 0.01 degrees, 0.05 degrees, 0.1 degrees, 0.15 degrees, 0.2 degrees) between the temperature within the thermal load 114 (e.g., indicated via feedback from the first sensor 132) and the set point temperature (e.g. indicated via the thermostat 134), operation of the HVAC system 100 may be initialized. For example, based on a determination that the temperature within the thermal load 114 is greater than the set point temperature (e.g., greater than the set point temperature by a threshold difference or threshold amount), the thermostat 134 may generate a call for cooling, and the HVAC system 100 may initiate operation in a cooling mode in response to the call for cooling. However, it should be appreciated that operation of the HVAC system 100 may be initialized (e.g., power may be supplied to the HVAC system 100) in other circumstances, such as in response to power cycling or resetting of the HVAC system 100, resumption of supply of power following a loss of power, and so forth.

The HVAC system 100 further includes a controller 136 (e.g., a control system, a control panel 82, control circuitry) configured to enable operation of the HVAC system 100 in accordance with the presently disclosed techniques. The controller 136 is communicatively coupled to one or more components of the HVAC system 100 and is configured to monitor, adjust, and/or otherwise control operation of the components of the HVAC system 100. For example, one or more control transfer devices, such as wires, cables, wireless communication devices, and the like, may communicatively couple the compressor 110, the motor 126, the VSD 128, the sensors 130, the thermostat 134, and/or any other suitable components of the HVAC system 100 to the controller 136. That is, the compressor 110, the motor 126, the VSD 128, the sensors 130, the thermostat 134 may each have one or more communication components that facilitate wired or wireless (e.g., via a network) communication with the controller 136. In some embodiments, the communication components may include a network interface that enables the components of the HVAC system 100 to communicate via various protocols such as EtherNet/IP, ControlNet, DeviceNet, or any other communication network protocol. Alternatively, the communication components may enable the components of the HVAC system 100 to communicate via mobile telecommunications technology, Bluetooth®, near-field communications technology, and the like. As such, the compressor 110, the motor 126, the VSD 128, the sensors 130, the thermostat 134, and the controller 136 may wirelessly communicate data between each other. In other embodiments, operational control of certain components of the HVAC system 100 may be regulated by one or more relays or switches (e.g., a 24 volt alternating current [VAC] relay).

In some embodiments, the controller 136 may be a component of or may include the control panel 82. In other embodiments, the controller 136 may be a standalone controller, a dedicated controller, or another suitable controller included in the HVAC system 100. In any case, the controller 136 is configured to control components of the HVAC system 100 in accordance with the techniques discussed herein. The controller 136 includes processing circuitry 138, such as one or more microprocessors, which may execute software for controlling the components of the HVAC system 100. The processing circuitry 138 may include multiple microprocessors, one or more "general-purpose" microprocessors, one or more special-purpose microprocessors, and/or one or more application specific integrated circuits (ASICS), or some combination thereof. For example, the processing circuitry 138 may include one or more reduced instruction set (RISC) processors.

The controller 136 may also include a memory device 140 (e.g., a memory) that may store information, such as instructions, control software, look up tables, configuration data, etc. The memory device 140 may include a volatile memory, such as random access memory (RAM), and/or a nonvolatile memory, such as read-only memory (ROM). The memory device 140 may store a variety of information and may be used for various purposes. For example, the memory device 140 may store processor-executable instructions including firmware or software for the processing circuitry 140 execute, such as instructions for controlling components of the HVAC system 100. In some embodiments, the memory device 140 includes one or more tangible, non-transitory, machine-readable-media that may store machine-readable instructions for the processing circuitry 138 to execute. The memory device 140 may include ROM, flash memory, a hard drive, or any other suitable optical, magnetic, or solid-state storage medium, or a combination thereof. The memory device 140 may store data, instructions, and any other suitable data. In some embodiments, one or more components of the controller 136 (e.g., processing circuitry 138, memory device 140) may be components of the thermostat 134. It should be appreciated that the thermostat 134, the controller 136, and components thereof (e.g., processing circuitry 138, memory device 140) may be elements of a control system of the HVAC system 100.

In accordance with present techniques, the controller 136 is configured to control operation of the HVAC system 100 in a more efficient manner at start up or initial operation of the HVAC system 100. In particular, the controller 136 may initially operate the HVAC system 100 at a reduced or intermediate operating capacity (e.g., instead of initially ramping up the HVAC system 100 to operate at a full capacity). In the illustrated embodiment, the presently disclosed techniques may be utilized during start up operation and/or initial operation of the HVAC system 100 in a cooling mode (e.g., to cool the first air flow 120 supplied to the thermal load 114). However, as described further below, the techniques disclosed herein may be implemented in a start up operation of the HVAC system 100 in a heating mode.

An operator or user may designate or establish a target or set point temperature for the thermal load 114. For example, a user may input a target or set point temperature via a user device 142 (e.g., touchscreen, button, scroll wheel, etc.). In some embodiments, the user device 142 may be a component of the thermostat 134. Additionally or alternatively, the user device 142 may be a mobile device or other device separate from the thermostat 134. As discussed above, the first sensor 132 may provide data and/or feedback indicative of a temperature (e.g., a measured or detected temperature) within the thermal load 114. For example, the first sensor 132 may provide the data to the thermostat 134 and/or to the controller 136. In some embodiments, the thermostat 134 may compare the temperature of the thermal load 114 with the set point temperature (e.g., received via the user device 142) and may determine that the temperature of the thermal load 114 deviates from (e.g., is greater than) the set point temperature. In response, the thermostat 134 may generate a call for cooling and may transmit the call for cooling (e.g., signal) to the controller 136. It should be appreciated that, in some embodiments, the controller 136 may receive the data from the first sensor 132 and/or the user device 142 and may determine that a call for cooling exists based on a determination that the temperature of the thermal load 114 deviates from (e.g., is greater than) the set point temperature.

In response to receipt of the call for cooling, the controller 136 may initialize operation of the HVAC system 100 in a cooling mode. That is, the controller 136 may transition the HVAC system 100 from an idle state to an operating state by, for example, initializing operation of the VSD 128, the motor 126, and the compressor 110 to enable circulation of working fluid through the working fluid circuit 104. In accordance with present techniques, the controller 136 may control the VSD 128, the motor 126 and/or the compressor 110 to initially operate at (e.g., ramp up to) a reduced or intermediate operating capacity. As used herein, an "intermediate operating capacity" may refer to an operating capacity that is less than an upper threshold (e.g., upper limit, maximum, full) capacity at which the VSD 128, the motor 126 and/or compressor 110 are configured to operate. In some embodiments, the intermediate operating capacity may be approximately 40 percent, 50 percent, or 60 percent of a full (e.g., total) operating capacity of the compressor 110. In some embodiments, the operating capacity may be described, represented, and/or indicated by an operating parameter (e.g., operating speed) of the compressor 110, the motor 126, and/or the VSD 128. For example, the intermediate operating capacity of the compressor 110 and/or the motor 126 may be 2500 revolutions per minute (RPM) or 2700 RPM, in some embodiments. In some embodiments, the operating capacity may be described, represented, and/or indicated by an operating parameter of the VSD 128, such as a frequency of the VSD 128.

Upon initial operation of the HVAC system 100, the controller 136 and/or the thermostat 134 may also determine whether the deviation between the temperature of the thermal load 114 (e.g., a first temperature) and the set point temperature is within (e.g., equal to or less than) a threshold difference value. For example, in some embodiments, the thermostat 134 may determine a value of the deviation between the temperature of the thermal load 114 and the set point temperature and may output the value of the deviation to the controller 136. The controller 136 may receive the value of the deviation and may compare the value of the deviation to the threshold difference value, which may be stored on the memory device 140 of the controller 136, to determine whether the deviation is within (e.g., equal to or less than) the threshold difference value.

The threshold difference value may be any suitable difference value, such as 1.0 degrees Fahrenheit, 0.7 degrees Fahrenheit, 0.6 degrees Fahrenheit, 0.5 degrees Fahrenheit, 0.4 degrees Fahrenheit, 0.3 degrees Fahrenheit, between 0.2 degrees and 0.5 degrees Fahrenheit, or any other suitable difference value. Thus, if the set point temperature indicated by the thermostat 134 (e.g., user device 142) is 72.0 degrees Fahrenheit, the temperature of the thermal load 114 is 72.5 degrees Fahrenheit, and the threshold difference value is 0.5 degrees Fahrenheit, the controller 136 may determine that the deviation between the temperature of the thermal load 114 and the set point temperature is within the threshold difference value. Similarly, if the set point temperature indicated by the thermostat 134 is 72.0 degrees Fahrenheit, the temperature of the thermal load 114 is 71.5 degrees Fahrenheit, and the threshold difference value is 0.5 degrees Fahrenheit, the controller 136 may determine that the deviation between the temperature of the thermal load 114 and the set point temperature is within the threshold difference value. As will be appreciated, the threshold difference value may be considered and/or may be indicative of a "deadband region" of the HVAC system 100 (e.g., the controller 136). Thus, in the examples provided above, the deadband region may be from 71.5 degrees to 72.5 degrees.

Based on a determination that the deviation between the temperature of the thermal load 114 and the set point temperature is within the threshold difference value or deadband region, the controller 136 may operate (e.g., initially operate, initialize operation) the compressor 110 (e.g., the VSD 128, the motor 126) at an intermediate operating capacity. In other words, the controller 136 may not initialize operation of the compressor 110 and ramp up the compressor 110 to a full or total operating capacity. In this way, the HVAC system 100 may operate with reduced energy consumption, thereby enabling a reduction in generation of greenhouse gas emissions. In some embodiments, the intermediate operating capacity may be predetermined (e.g., fixed). In other embodiments, the controller 136 may be configured to select a particular intermediate operating capacity at which to operate the compressor 110 upon the determination that the deviation between the temperature of the thermal load 114 and the set point temperature is within the threshold difference value. For example, the controller 136 may select a particular intermediate operating capacity of a plurality of intermediate operating capacities (e.g., stored in the memory device 140) based on an operating parameter of the HVAC system 100 (e.g., ambient temperature, detected by one of the sensors 130), based on an operating mode of the HVAC system 100 (e.g., heating, cooling), another suitable operating parameter, or any combination thereof. In some embodiments, the controller 136 may select a particular intermediate operating capacity of a plurality of intermediate operating capacities based on an amount of the deviation (e.g., a value of the deviation expressed as a percentage of the threshold difference value).

The controller 136 may operate the compressor 110 (e.g., the VSD 128, the motor 126) at the intermediate operating capacity for a predetermined period of time (e.g., an initial time period, threshold time period). The predetermined period of time may be selected or determined based on any suitable factors, such as a size of the thermal load 114, a total operating capacity of the HVAC system 100 (e.g., the compressor 110), an environment of the HVAC system 100 (e.g., an outdoor or ambient temperature), an operating mode of the HVAC system 100 (e.g., heating, cooling) and/or other variables. In some embodiments, the predetermined period of time may be approximately 2 minutes, 3 minutes, 4 minutes, 5 minutes, 6 minutes, 7 minutes, 8 minutes, or any other suitable length of time. In some embodiments, the predetermined period of time may be preselected (e.g., fixed) for a particular embodiment of the HVAC system 100. The controller 136 may monitor or track an amount of the predetermined period of time that has elapsed via a timer 144 of the controller 136. That is, the controller 136 may utilize the timer 144 to monitor an elapsed time from initialized operation of the HVAC system 100 (e.g., the compressor 110, initial operation of the compressor 110 at the intermediate operating capacity) until the elapsed time is equal to or substantially equal to the predetermined period of time.

Upon lapse of the predetermined period of time, the controller 136 may again determine whether a deviation between a temperature of the thermal load 114 (e.g., an updated temperature, a recent temperature, second temperature) and the set point temperature is within (e.g., equal to or less than) the threshold difference value. For example, the controller 136 may receive updated feedback or data from the first sensor 132 (e.g., via the thermostat 134) indicative of the temperature within the thermal load 114, compare the updated temperature within the thermal load 114 to the set point temperature, and determine whether an updated deviation between the updated temperature of the thermal load 114 and the set point temperature is within the threshold difference value. Based on a determination that the deviation between the updated temperature of the thermal load 114 and the set point temperature remains within the threshold difference value (e.g., equal to or less than 0.5 degrees Fahrenheit), the controller 136 may adjust the VSD 128, the motor 126 and/or compressor 110 to operate at a further reduced operating capacity that is less than the intermediate operating capacity utilized at start up of the HVAC system 100 and during the predetermined period of time. In some embodiments, the further reduced operating capacity may be a lower threshold (e.g., lower limit, minimum) operating capacity of the compressor 110 (e.g., the VSD 128, the motor 126). In some embodiments, the lower threshold operating capacity may be a minimum allowable operating capacity of the compressor 110, which may be determined based one or more factors, such as a design or characteristic of the compressor 110, a design or characteristic of the motor 126, a design or characteristic of the VSD 128, an operating condition or parameter of the HVAC system 100, and/or any other suitable factor. For example, the minimum allowable operating capacity of the compressor 110 may be determined based at least in part on feedback or data provided by a second sensor 146 of the one or more sensors 130. The second sensor 146 may be an ambient temperature sensor configured to measure or detect a temperature of the ambient environment 116 (e.g., outdoor environment) in which the HVAC system 100 and/or the compressor 110 operate.

During operation of the HVAC system 100 with the compressor 110 operating at the lower threshold operating capacity, the controller 136 may continue to receive data and/or feedback from the first sensor 132, the second sensor 146, another sensor 130, and/or the thermostat 134. Thus, the controller 136 may continue to receive updated data indicative of the temperature of the thermal load 114, updated data indicative of an operating parameter (e.g., ambient temperature) of the HVAC system 100, and/or updated data indicative of the set point temperature of the thermal load 114. Based on the updated data and/or feedback, the controller 136 may adjust the lower threshold operating capacity of the compressor 110 (e.g., to provide an updated lower threshold operating capacity, to provide an updated operating capacity). The controller 136 may also continue to compare (e.g., iteratively compare) the temperature of the thermal load 114 and the set point temperature to determine whether a deviation between the temperature and the set point temperature is within the threshold difference value. Upon a determination that the deviation exceeds the threshold difference value, the controller 136 may stage (e.g., increase) the operating capacity of the compressor 110 (e.g., the motor 126, the VSD 128) according to staging control scheme (e.g., based on a magnitude of the deviation, based on a difference between the deviation and the threshold difference value). The controller 136 may also suspend operation of the compressor 110 (e.g., the motor 126, the VSD 128) and/or HVAC system 100 upon a determination that the temperature of the thermal load 114 does not deviate from (e.g., is equal to, approximately equal to, or substantially equal to) the set point temperature and/or upon a determination that the call for cooling is otherwise satisfied.

Figure 6:
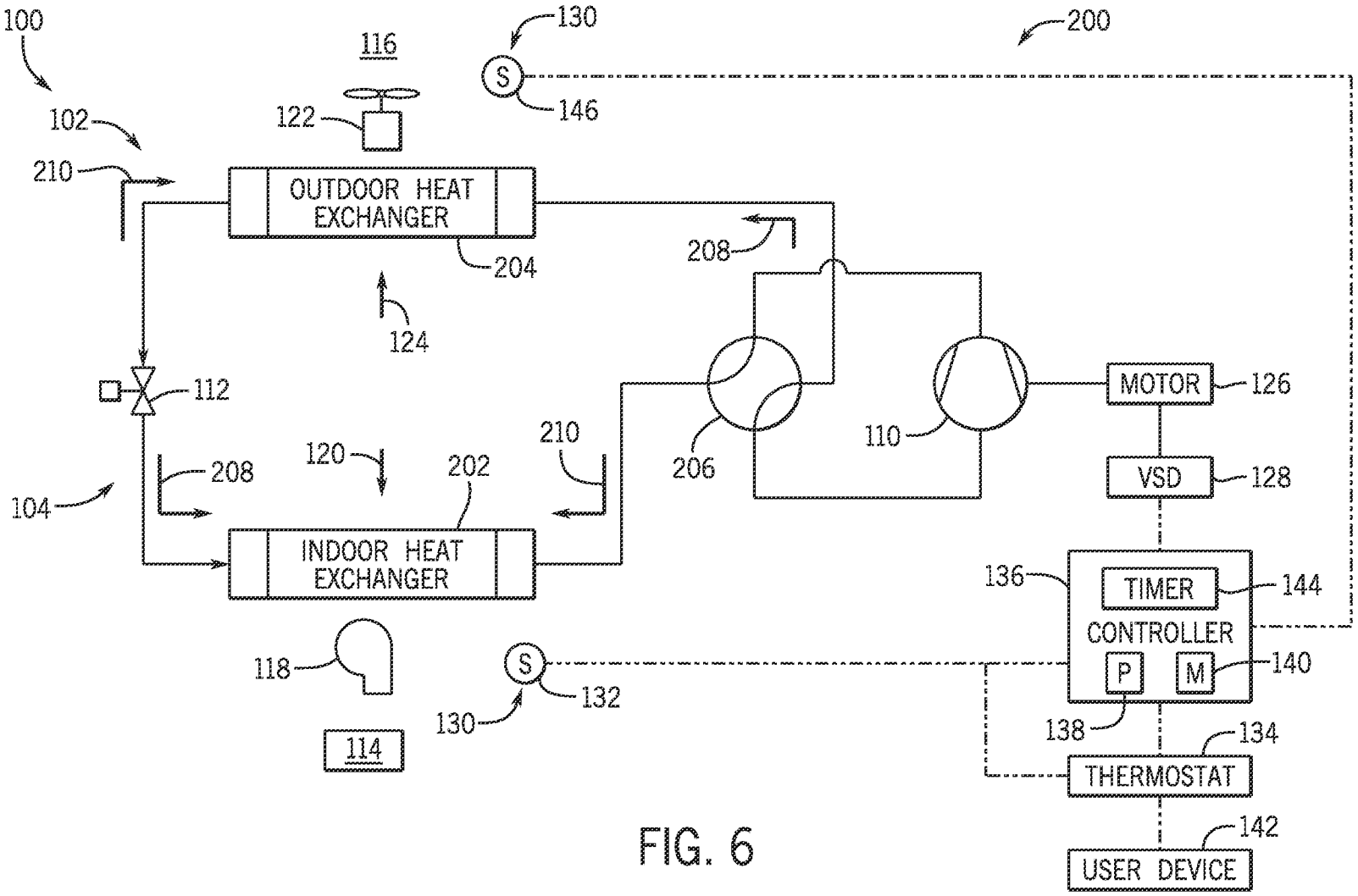
FIG. 6 is a schematic diagram of an embodiment of an HVAC system including a vapor compression system and a controller configured to enable improved operation of the HVAC system at start up, in accordance with an aspect of the present disclosure.

It should be appreciated that techniques similar to those described above may be utilized upon initial operation of the HVAC system 100 in a heating mode. For example, FIG. 6 is a schematic of an embodiment of the HVAC system 100 including the vapor compression system 102 configured as a heat pump system 200. The illustrated embodiment includes elements and element numbers similar to those discussed above with reference to FIG. 5. For example, the vapor compression system 102 includes the working fluid circuit 104 having an indoor heat exchanger 202 (e.g., evaporator, first heat exchanger), an outdoor heat exchanger 204 (e.g., condenser, second heat exchanger), the compressor 110, and the expansion valve 112. The working fluid circuit 104 also includes a reversing valve 206 (e.g., switchover valve) configured to adjust (e.g., reverse) a flow direction of the working fluid along the working fluid circuit 104 of the heat pump system 200.

During operation of the heat pump system 200 in a cooling mode, the compressor 110 may direct working fluid through the working fluid circuit 104, the indoor heat exchanger 202, and the outdoor heat exchanger 204 in a first flow direction 208. While receiving working fluid in the first flow direction 208, the indoor heat exchanger 202, which is in thermal communication with the thermal load 114, may operate as an evaporator. Thus, working fluid flowing through the indoor heat exchanger 202 may absorb thermal energy from the first air flow 120 directed to the thermal load 114. The outdoor heat exchanger 204, which may be positioned in the ambient environment 116 surrounding the heat pump system 200, may operate as a condenser to reject the heat absorbed by the working fluid flowing from the indoor heat exchanger 202 to the second air flow 124 (e.g., ambient air flow) directed across the outdoor heat exchanger 204. The techniques described above with reference to FIG. 5 may be similarly implemented during initial operation of the heat pump system 200 in the cooling mode. For example, in response to a call for cooling (e.g., received from the thermostat 134) and based on a determination that a deviation between a temperature of the thermal load 114 and a set point temperature is within a threshold difference value or deadband region, the controller 136 may operate (e.g., initially operate, initialize operation) the compressor 110 (e.g., the VSD 128, the motor 126) at an intermediate operating capacity for a predetermined period of time.

During operation of the heat pump system 200 in a heating mode, the reversing valve 206 enables the compressor 110 to direct working fluid through the working fluid circuit 104, the indoor heat exchanger 202, and the outdoor heat exchanger 204 in a second flow direction 210, opposite the first flow direction 208. While receiving working fluid in the second flow direction 210, the indoor heat exchanger 202 may operate as a condenser instead of an evaporator, and the outdoor heat exchanger 204 may operate as an evaporator instead of a condenser. As such, the indoor heat exchanger 202 may receive (e.g., from the compressor 110) a flow of heated working fluid to reject heat to the first air flow 120 directed to the thermal load 114 and thereby facilitate heating of the thermal load 114.

In embodiments of the HVAC system 100 configured as the heat pump system 200, the controller 136 may control operation of the VSD 128, the motor 126, and/or the compressor 110 during start up operation and/or initial operation of the HVAC system 100 in a heating mode in a manner similar to that described above with regards to the operation of the HVAC system in the cooling mode. For example, the first sensor 132 may provide data and/or feedback indicative of a temperature (e.g., a measured or detected temperature) within the thermal load 114 to the thermostat 134, and the thermostat 134 may compare the temperature of the thermal load 114 with the set point temperature (e.g., received via the user device 142). The thermostat 134 may determine that the temperature of the thermal load 114 deviates from (e.g., is less than) the set point temperature. In response, the thermostat 134 may generate a call for heating and may transmit the call for heating (e.g., signal) to the controller 136. In response to receipt of the call for heating, the controller 136 may initialize operation of the heat pump system 200 in the heating mode. To this end, the controller 136 may control and/or adjust a position of the reversing valve 206 to enable flow of the working fluid through the working fluid circuit 104 in the second flow direction 210.

The controller 136 may also initialize operation of the VSD 128, the motor 126, and the compressor 110 to enable circulation of working fluid through the working fluid circuit 104 in the second flow direction 210. Specifically, the controller 136 may control the VSD 128, the motor 126 and/or the compressor 110 to initially operate at (e.g., ramp up to) a reduced or intermediate operating capacity (e.g., instead of a full capacity) for a predetermined period of time. The controller 136 may similarly implement the techniques described above with reference to FIG. 5 to control operation of the VSD 128, the motor 126 and/or the compressor 110 based on a deviation between a temperature of the thermal load 114 and a set point temperature, comparison of the deviation with a threshold temperature difference, and so forth. In this way, the heat pump system 200 may operate with reduced energy consumption, thereby enabling a reduction in generation of greenhouse gas emissions.

Figure 7:
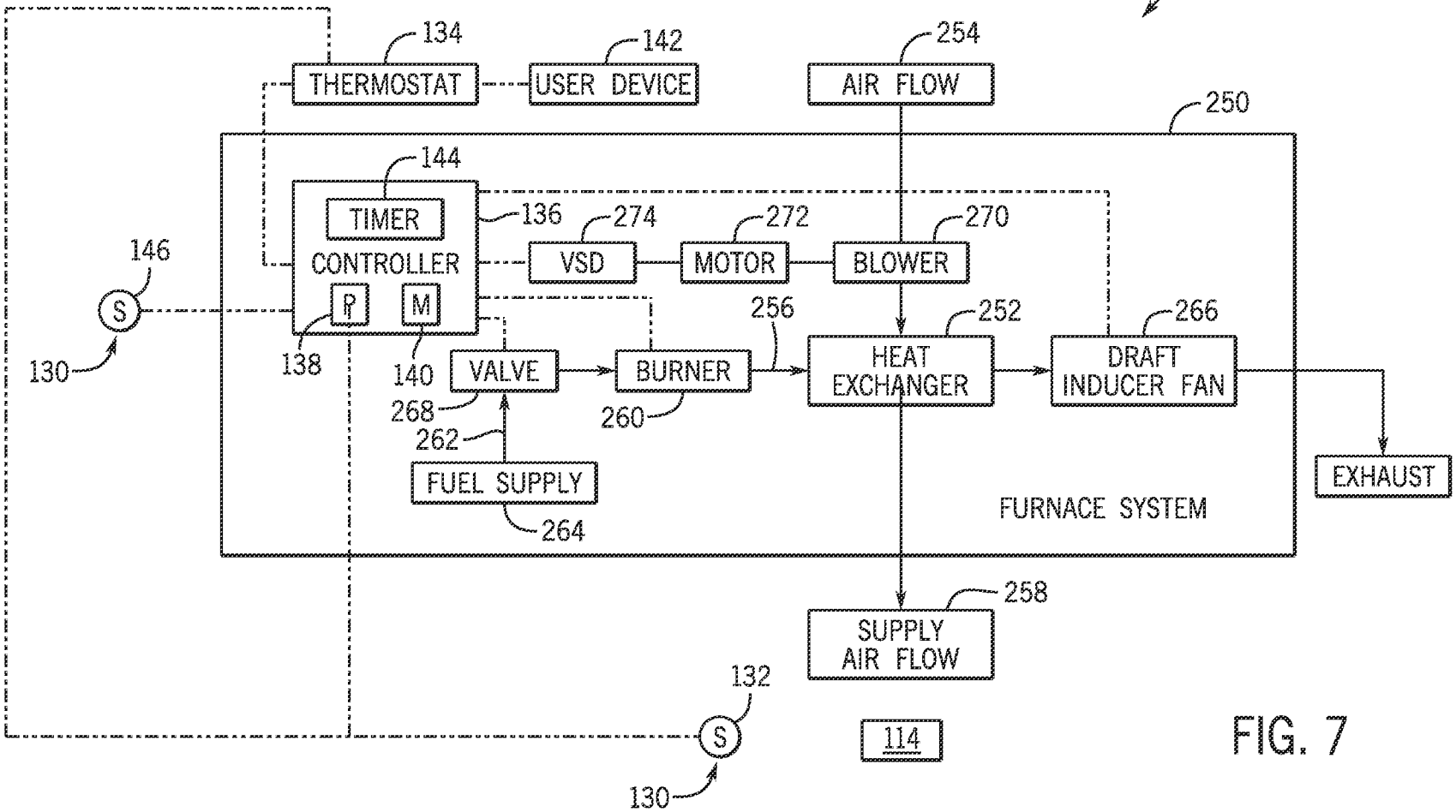
FIG. 7 is a schematic diagram of an embodiment of an HVAC system including a furnace and a controller configured to enable improved operation of the HVAC system at start up, in accordance with an aspect of the present disclosure.

The presently disclosed techniques may also be implemented with embodiments of the HVAC system 100 including a furnace system. To facilitate the following discussion, FIG. 7 is a schematic of an embodiment of a portion of the HVAC system 100, illustrating a furnace system 250 (e.g., a furnace). The furnace system 250 may be an embodiment of the furnace system 70 incorporated with the residential heating and cooling system 50 discussed above. However, it should be appreciated that the furnace system 250 may be incorporated with embodiments of the HVAC unit 12, the vapor compression system 72, and/or any other suitable HVAC system. The HVAC system 100 also includes an embodiment of the controller 136, as well as other elements and element numbers similar to those discussed above with reference to FIGS. 5 and 6. As discussed further below, the controller 136 is configured to implement the techniques described herein to control operation of the furnace system 250 in a more efficient manner at start up or initial operation of the furnace system 250 to enable reduced energy consumption and reduced generation of greenhouse gas emissions.

The furnace system 250 includes a heat exchanger 252 configured to heat an air flow 254 (e.g., a return air flow, an ambient air flow, a mixed air flow, a supply air flow) directed across the heat exchanger 252. The heat exchanger 252 may include one or more tubes configured to receive combustion products 256 (e.g., a working fluid), and the heat exchanger 252 may place the air flow 254 in a heat exchange relationship with the combustion products 256 to transfer heat from the combustion products 256 to the air flow 254, thereby heating the air flow 254 to produce a supply air flow 258 (e.g., heated air flow) that is directed to the thermal load 114 to provide heating to the thermal load 114. The furnace system 250 also includes a burner 260 configured to receive fuel 262 from a fuel supply 264. The burner 260 may ignite the fuel 262 (e.g., an air-fuel mixture) to produce the combustion products 256, and a draft inducer fan 266 (e.g., a draft inducer blower, draft inducer) may direct (e.g., force, draw) the combustion products 256 through the heat exchanger 252 (e.g., through tubes of the heat exchanger 252). The furnace system 250 further includes a valve 268 (e.g., a fuel valve) configured to control a flow rate of fuel 262 directed to the burner 260 and therefore control a rate at which the combustion products 256 are produced by the burner 260 and directed through the heat exchanger 252. In some embodiments, the valve 268 may be operated to control an amount of fuel 262 in an air-fuel mixture generated and/or ignited by the burner 260, thereby enabling control of an amount of heat generated via the combustion products 256 for transfer to the air flow 254. Thus, operation of the valve 268 may be controlled to adjust a temperature of the supply air flow 258 generated by the furnace system 250.

The HVAC system 100 also includes a blower 270 (e.g., fan) configured to force the air flow 254 across the heat exchanger 252 and/or to deliver the supply air flow 258 to the thermal load 114 to heat the thermal load 114 (e.g., conditioned space). In some embodiments, the blower 270 is a component of the furnace system 250 (e.g., disposed within a housing of the furnace system 250). In other embodiments, the blower 270 may be a component of the HVAC system 100 (e.g., air handling unit, rooftop unit, etc.) having the furnace system 250. The blower 270 may be driven into rotation by a motor 272, and operation of the motor 272 may be controlled by a VSD 274 (e.g., furnace VSD) to enable adjustment of a flow rate of the air flow 254 across the heat exchanger 252 and/or a flow rate of the supply air flow 258 directed to the thermal load 114.

In embodiments of the HVAC system 100 including the furnace system 250, the controller 136 may initially operate the furnace system 250 at an intermediate operating capacity (e.g., less than a full operating capacity, approximately half operating capacity) upon start up of the HVAC system 100 in response to a call for heating (e.g., received from the thermostat 134. For example, the first sensor 132 may provide data and/or feedback indicative of a temperature (e.g., a measured or detected temperature) within the thermal load 114 to the thermostat 134, and the thermostat 134 may compare the temperature of the thermal load 114 with the set point temperature (e.g., received via the user device 142). The thermostat 134 may determine that the temperature of the thermal load 114 deviates from (e.g., is less than) the set point temperature. Based on a determined difference (e.g., 0.01 degrees, 0.05 degrees, 0.1 degrees, 0.15 degrees, 0.2 degrees) between the temperature within the thermal load 114 and the set point temperature, operation of the HVAC system 100 may be initialized. For example, based on a determination that the temperature within the thermal load 114 is less than the set point temperature (e.g., greater than the set point temperature by a threshold difference or threshold amount), the thermostat 134 may generate a call for heating and transmit the call for heating to the controller 136. In response to receipt of the call for heating, the controller 136 may initialize operation of the furnace system 250.

In accordance with present techniques, the controller 136 is configured to control operation of the furnace system 205 in a more efficient manner at start up or initial operation of the HVAC system 100 in the heating mode. In particular, the controller 136 may initially operate the furnace system 250 at a reduced or intermediate operating capacity (e.g., instead of initially ramping up the furnace system 250 to operate at a full capacity). In this way, present embodiments of the furnace system 250 are configured to operate with reduced energy consumption and reduced generation of greenhouse gas emissions.

For example, in response to receipt of the call for heating, the controller 136 may control the valve 268, the burner 260, and/or the draft inducer fan 266 to initially operate at (e.g., ramp up to) a reduced or intermediate operating capacity. As used herein, an "intermediate operating capacity" may refer to an operating capacity that is less than an upper threshold (e.g., upper limit, maximum, full) capacity at which the draft inducer fan 266, the valve 268 and/or the burner 260 are configured to operate. In some embodiments, the intermediate operating capacity may be approximately 40 percent, 50 percent, or 60 percent of a full (e.g., total) operating capacity of the furnace system 250. In some embodiments, the operating capacity may be described, represented, and/or indicated by an operating parameter of the burner 260, the draft inducer fan 266, and/or the valve 268. For example, the intermediate operating capacity of the draft inducer fan 266 may correspond to an intermediate or reduced operating speed of the draft inducer fan 266 that is less than a full speed of the draft inducer fan 266. Additionally or alternatively, the intermediate operating capacity of the furnace system 250 may correspond to intermediate or reduced firing rate of the furnace system 250 that is less than a full or upper limit firing rate of the furnace system 250. In some instances, a position of the valve 268 (e.g., an amount or percentage in which the valve 268 is open) may be referred to as a "firing rate" of the furnace system 250. Thus, the intermediate operating capacity of the furnace system 250 may correspond to intermediate or reduced position of the valve 268 (e.g., percentage of opening, intermediate firing rate) that is less than a fully open position of the valve 268 (e.g., full firing rate). Additionally or alternatively, the intermediate operating capacity of the furnace system 250 may correspond to intermediate or reduced operation of the burner 260, such as an intermediate or reduced flame temperature, flame size, flame length, or any other suitable operating parameter of the burner 260. Accordingly, at the intermediate operating capacity, the furnace system 250 may generate a reduced amount of combustion products 256 and therefore operate with reduced generation of greenhouse gas emissions. Operation of the draft inducer fan 266 at the intermediate operating capacity may also result in reduced energy consumption of the furnace system 250.

As similarly described above, upon initial operation of the furnace system 250 in response to receipt of the call for heating, the controller 136 may determine whether a deviation between a temperature of the thermal load 114 and a set point temperature is within a threshold difference value or deadband region. In response to a determination that the deviation is within the threshold difference value, the controller 136 may operate (e.g., initially operate, initialize operation) the furnace system 250 at an intermediate operating capacity. In other words, the controller 136 may not initialize operation of the furnace system 250 and ramp up the furnace system 250 to a full or total operating capacity. The controller 136 may operate the furnace system 250 (e.g., the burner 260, the valve 268) at the intermediate operating capacity for a predetermined period of time (e.g., an initial time period, threshold time period).

Upon lapse of the predetermined period of time, the controller 136 may again determine whether a deviation between a temperature of the thermal load 114 (e.g., an updated temperature, a recent temperature, second temperature) and the set point temperature is within (e.g., equal to or less than) the threshold difference value. Based on a determination that the deviation between the updated temperature of the thermal load 114 and the set point temperature remains within the threshold difference value (e.g., equal to or less than 0.5 degrees Fahrenheit), the controller 136 may adjust furnace system 250 (e.g., the burner 260, the draft inducer fan 266, and/or the valve 268) to operate at a further reduced operating capacity that is less than the intermediate operating capacity utilized at start up of the furnace system 250 and during the predetermined period of time. In some embodiments, the further reduced operating capacity may be a lower threshold (e.g., lower limit, minimum) operating capacity of the furnace system (e.g., the burner 260, the draft inducer fan 266, and/or the valve 268).

During operation of the HVAC system 100 with the furnace system 250 operating at the lower threshold operating capacity, the controller 136 may continue to receive data and/or feedback from the first sensor 132, another sensor 130, and/or the thermostat 134. Thus, the controller 136 may continue to receive updated data indicative of the temperature of the thermal load 114, updated data indicative of an operating parameter of the HVAC system 100, and/or updated data indicative of the set point temperature of the thermal load 114. Based on the updated data and/or feedback, the controller 136 may adjust the lower threshold operating capacity of the furnace system 250 (e.g., to provide an updated lower threshold operating capacity, to provide an updated operating capacity). The controller 136 may also continue to compare (e.g., iteratively compare) the temperature of the thermal load 114 and the set point temperature to determine whether a deviation between the temperature and the set point temperature is within the threshold difference value. Upon a determination that the deviation exceeds the threshold difference value, the controller 136 may stage (e.g., increase) the operating capacity of the furnace system 250 (e.g., the burner 260, the draft inducer fan 266, and/or the valve 268) according to staging control scheme (e.g., based on a magnitude of the deviation, based on a difference between the deviation and the threshold difference value). The controller 136 may also suspend operation of the furnace system 250 (e.g., the burner 260, the draft inducer fan 266, and/or the valve 268) and/or HVAC system 100 upon a determination that the temperature of the thermal load 114 does not deviate from (e.g., is equal or substantially equal to) the set point temperature and/or upon a determination that the call for heating is otherwise satisfied.

Figure 8:
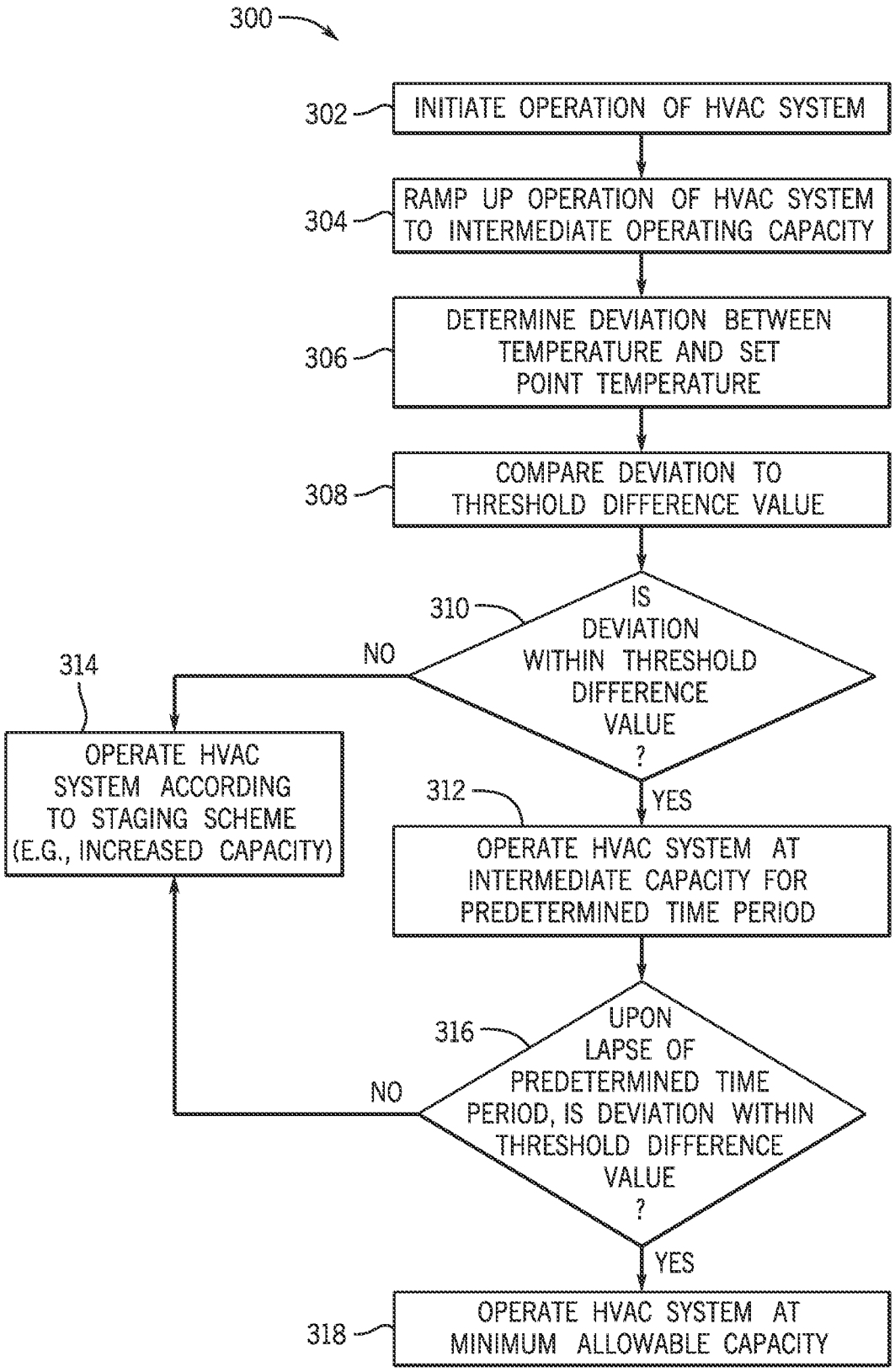
FIG. 8 is a flow chart of an embodiment of a method for operating an HVAC system at start up, in accordance with an aspect of the present disclosure.

FIG. 8 is a flow chart of an embodiment of method 300 for operating the HVAC system 100 in accordance with the present techniques. Specifically, the method 300 describes a control scheme for operating the HVAC system 100 upon initial start up or operation of the HVAC system 100. As described in detail above, the method 300 may be utilized in embodiments of the HVAC system 100 configured as the heat pump system 200, embodiments of the HVAC system 100 including the furnace system 250, in a cooling mode of the HVAC system 100 and/or in a heating mode of the HVAC system 100. As will be appreciated, one or more steps of the method 300 may be performed by the controller 136. For example, computer executable instructions or code for performing the method 300 may be stored on the memory device 140, and the processing circuitry 138 may execute the instructions to perform the method 300. In some embodiments, one or more steps of the method 300 may be performed by another controller of the HVAC system 100. In additional or alternative embodiments, multiple components or systems may perform the steps of the method 300. It should also be noted that additional steps may be performed with respect to the depicted method 300. Moreover, certain steps of the method 300 may be removed, modified, and/or performed in a different order. Further still, the steps of the method 300 may be performed in any suitable relation with one another, such as in response to one another and/or in parallel with one another.

As indicated by block 302, operation of the HVAC system 100 may be initiated. For example, operation of the HVAC system 100 may be initiated in response to supply of power to the HVAC system 100, in response to a call for conditioning (e.g., heating, cooling) received by the HVAC system 100 (e.g., received by the controller 136 from the thermostat 134), and so forth. As indicated by block 304, operation of the HVAC system 100 is ramped up to an intermediate operating capacity upon initialization of HVAC system 100 operation. For example, in a cooling mode, the controller 136 may initialize operation of the compressor 110 and ramp up the compressor 110 to operate at an intermediate operating capacity that is less than a full or total operating capacity of the compressor 110. Similarly, in a heating mode of the HVAC system 100 having the heat pump system 200, the controller 136 may initialize operation of the compressor 110 and ramp up the compressor 110 to operate at an intermediate operating capacity that is less than a full or total operating capacity of the compressor 110. In a heating mode of the HVAC system 100 having the furnace system 250, the controller 136 may initialize operation of the furnace system 250 and ramp up the burner 260, the draft inducer fan 266, and/or the valve 268 to operate at an intermediate operating capacity that is less than a full or total operating capacity of the furnace system 250.

Additionally, upon start up of the HVAC system 100, a deviation between a temperature within the thermal load 114 and a set point temperature of the thermal load 114 may be determined, such as via the controller 136, as indicated by block 306. The controller 136 may determine the deviation based on feedback and/or data received from one or more of the sensors 130 (e.g., first sensor 132), received from the thermostat 134 (e.g., user device 142), and/or received from another suitable source. As indicated by block 308, the controller 136 may also compare the deviation to a threshold difference value (e.g., a deadband region or value). At block 310, a determination is made regarding whether the deviation is within (e.g., equal to, less than, equal to or less than) the threshold difference value. Based on a determination that the deviation is within the threshold difference value, the controller 136 may operate the HVAC system 100 at the intermediate operating capacity for a predetermined period of time (e.g., 5 minutes), as indicated at block 312. Based on a determination that the deviation is not within the threshold difference value, the HVAC system 100 may be operated according to another staging scheme, as indicated at block 314, whereby the operating capacity of the HVAC system 100 may be increased or otherwise adjusted according to a demand on the HVAC system 100 (e.g., a magnitude of the deviation).

Continuing to block 316 from block 312, upon lapse of the predetermined period of time, the deviation (e.g., updated deviation) between the temperature (e.g., an updated temperature) within the thermal load 114 and the set point temperature of the thermal load 114 may again be compared to threshold difference value to determine whether the deviation remains within the threshold difference value. For example, an updated deviation between an updated temperature of the thermal load 114 and the set point temperature may be determined (e.g., upon lapse of the predetermined period of time, via data received from the first sensor 132, by the thermostat 134, by the controller 136) and compared (e.g., by the controller 136) to the threshold difference value. Based on a determination that the updated deviation remains within the threshold difference value, the controller 136 may adjust the HVAC system 100 to operate at a further reduced (e.g., minimum allowable) operating capacity, as indicated at block 318. Based on a determination that the updated deviation is not within the threshold difference value, the HVAC system 100 may be operated according to another staging scheme, as indicated by block 314, whereby the operating capacity of the HVAC system 100 may be increased or otherwise adjusted according to a demand on the HVAC system 100.

In the manner described above, present embodiments enable improved operation of the HVAC system 100, particularly during initial operation of the HVAC system 100 (e.g., following an idle or non-operating period of the HVAC system 100). For example, the present techniques enable more efficient initial operation of the HVAC system 100 by enabling operation with reduced energy consumption and/or reduced generation of greenhouse gas emissions. The present techniques also enable more stable and balanced conditioning of a conditioned space by avoiding over-conditioning (e.g., overheating, overcooling) of the conditioned space during initial operation of the HVAC system and thereby reducing energy consumption and corresponding production of greenhouse gas emissions.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. An energy efficient heating, ventilation, and air conditioning (HVAC) system, comprising:

a variable capacity compressor configured to operate at a plurality of operating capacities;

a control system communicatively coupled to the variable capacity compressor, wherein the control system is configured to:

receive data indicative of a temperature within a conditioned space;

receive data indicative of a set point temperature of the conditioned space;

initialize operation of the variable capacity compressor; and ramp up operation of the variable capacity compressor to an intermediate operating capacity of the plurality of operating capacities during initial operation of the variable capacity compressor, wherein the intermediate operating capacity is less than a full operating capacity of the plurality of operating capacities, and the intermediate operating capacity is determined independently of the temperature within the conditioned space and the set point temperature of the conditioned space;

compare the temperature within the conditioned space with the set point temperature of the conditioned space; and based on a determination that a deviation between the temperature and the set point temperature is within a threshold difference value, maintain operation of the variable capacity compressor at the intermediate operating capacity of the plurality of operating capacities for a predetermined period of time, wherein, upon lapse of the predetermined period of time, the control system is configured to:

receive updated data indicative of an updated temperature within the conditioned space;

compare the updated temperature with the set point temperature; and based on a determination that an updated deviation between the updated temperature and the set point temperature remains within the threshold difference value, operate the variable capacity compressor at a lower threshold operating capacity of the plurality of operating capacities.

2. The energy efficient HVAC system of claim 1, wherein the control system is configured to:

receive the data indicative of the temperature within the conditioned space from a sensor of the energy efficient HVAC system; and receive the data indicative of the set point temperature of the conditioned space from a thermostat of the control system.

3. The energy efficient HVAC system of claim 1, wherein the control system is configured to maintain operation of the variable capacity compressor at the lower threshold operating capacity until a determination that an additional updated deviation between an additional updated temperature within the conditioned space and the set point temperature exceeds the threshold difference value or until the additional updated temperature within the conditioned space is approximately equal to the set point temperature.

4. The energy efficient HVAC system of claim 1, wherein the lower threshold operating capacity is a minimum allowable operating capacity of the variable capacity compressor.

5. The energy efficient HVAC system of claim 4, wherein the minimum allowable operating capacity of the variable capacity compressor is based at least in part on an ambient temperature.

6. The energy efficient HVAC system of claim 5, wherein the control system is configured to receive data indicative of the ambient temperature from a sensor of the energy efficient HVAC system.

7. The energy efficient HVAC system of claim 1, wherein the control system is configured to:

receive additional updated data indicative of an additional updated temperature within the conditioned space;

compare the additional updated temperature with the set point temperature; and based on a determination that an additional updated deviation between the additional updated temperature and the set point temperature exceeds the threshold difference value, operate the variable capacity compressor at an increased operating capacity of the plurality of operating capacities, wherein the increased operating capacity is greater than the lower threshold operating capacity.

8. The energy efficient HVAC system of claim 1, wherein the control system is configured to:

based on a determination that the temperature is greater than the set point temperature, initialize operation of the variable capacity compressor in a cooling mode of the energy efficient HVAC system; and ramp up operation of the variable capacity compressor to the intermediate operating capacity of the plurality of operating capacities during initial operation of the variable capacity compressor in the cooling mode of the energy efficient HVAC system.

9. The energy efficient HVAC system of claim 8, wherein the control system is configured to:

based on a determination that the temperature is less than the set point temperature, initialize operation of a furnace system of the energy efficient HVAC system in a heating mode of the energy efficient HVAC system; and ramp up operation of the furnace system to an intermediate firing rate of a plurality of firing rates during initial operation of the furnace system in the heating mode of the energy efficient HVAC system, wherein the intermediate firing rate is less than an upper threshold firing rate of the plurality of firing rates.

10. The energy efficient HVAC system of claim 1, wherein the control system is configured to:

based on a determination that the temperature is less than the set point temperature, initialize operation of the variable capacity compressor in a heating mode of the energy efficient HVAC system; and ramp up operation of the variable capacity compressor to the intermediate operating capacity of the plurality of operating capacities during initial operation of the variable capacity compressor in the heating mode of the energy efficient HVAC system.

11. A control system for an energy efficient heating, ventilation, and air conditioning (HVAC) system, wherein the control system comprises:

processing circuitry; and non-transitory, machine-readable-media comprising instructions stored thereon that, when executed by the processing circuitry, cause the processing circuitry to:

receive data indicative of a temperature within a conditioned space;

receive data indicative of a set point temperature of the conditioned space;

determine a deviation between the temperature and the set point temperature;

initialize operation of a compressor of the energy efficient HVAC system at an intermediate operating capacity of a plurality of operating capacities of the compressor, wherein the intermediate operating capacity is determined independently of the temperature within the conditioned space and the set point temperature of the conditioned space;

maintain operation of the compressor at the intermediate operating capacity for a predetermined period of time in response to a determination that the deviation is equal to or less than a threshold difference value; and upon lapse of the predetermined period of time:

receive updated data indicative of an updated temperature within the conditioned space;

compare the updated temperature with the set point temperature; and based on a determination that an updated deviation between the updated temperature and the set point temperature is equal to or less than the threshold difference value, operate the compressor at a reduced operating capacity of the plurality of operating capacities, wherein the reduced operating capacity is less than the intermediate operating capacity.

12. The control system of claim 11, wherein the reduced operating capacity is a minimum allowable operating capacity of the compressor.

13. The control system of claim 11, wherein the instructions, when executed by the processing circuitry, cause the processing circuitry to operate the compressor at an increased operating capacity of the plurality of operating capacities in response to a determination that the updated deviation is greater than the threshold difference value, wherein the increased operating capacity is greater than the intermediate operating capacity.

14. The control system of claim 11, wherein the instructions, when executed by the processing circuitry, cause the processing circuitry to:

initialize operation of the compressor at the intermediate operating capacity of the plurality of operating capacities in a cooling mode of the energy efficient HVAC system; and initialize operation of the compressor at the intermediate operating capacity of the plurality of operating capacities in a heating mode of the energy efficient HVAC system.

15. An energy efficient heating, ventilation, and air conditioning (HVAC) system, comprising:

a controller configured to:

receive a call for conditioning;

initialize operation of the energy efficient HVAC system at an intermediate operating capacity of a plurality of intermediate operating capacities in response to receipt of the call for conditioning;

receive data indicative of a set point temperature of a conditioned space from a thermostat of the energy efficient HVAC system;

receive data indicative of a temperature within the conditioned space from a sensor of the energy efficient HVAC system;

determine a deviation between the temperature and the set point temperature; compare the deviation to a threshold difference value; and maintain operation of the energy efficient HVAC system at the intermediate operating capacity for a predetermined period of time in response to a determination that the deviation is equal to or less than the threshold difference value, wherein the intermediate operating capacity is determined independently of the temperature within the conditioned space and the set point temperature of the conditioned space, and wherein, upon lapse of the predetermined period of time, the controller is configured to:

receive updated data from the sensor indicative of an updated temperature within the conditioned space;

determine an updated deviation between the updated temperature and the set point temperature; and based on a determination that the updated deviation between the updated temperature and the set point temperature is equal to or less than the threshold difference value, operate the energy efficient HVAC system at a minimum allowable operating capacity of the energy efficient HVAC system.

16. The energy efficient HVAC system of claim 15, comprising a variable capacity compressor, wherein the controller is configured to initialize operation of the variable capacity compressor at the intermediate operating capacity of the plurality of intermediate operating capacities in response to receipt of the call for conditioning.

17. The energy efficient HVAC system of claim 15, wherein the call for conditioning is a call for heating, the energy efficient HVAC system comprises a furnace system, and the controller is configured to initialize operation of the furnace system at the intermediate operating capacity of the plurality of intermediate operating capacities in response to receipt of the call for heating.

* * * * *